United States Patent [19]

Kaumeyer

[11] Patent Number: 4,859,084

[45] Date of Patent: Aug. 22, 1989

[54] HANGABLE COMPARTMENTED BAG

[76] Inventor: Jean M. Kaumeyer, 4784 Eddy Dr. E., Lewiston, N.Y. 14092

[21] Appl. No.: 235,177

[22] Filed: Aug. 23, 1988

[51] Int. Cl.[4] ..... A45C 11/24; A45C 3/12

[52] U.S. Cl. ..... 383/39; 383/22; 190/903

[58] Field of Search ..... 383/39, 4, 22; 190/903

[56] References Cited

U.S. PATENT DOCUMENTS

| | | | |
|---|---|---|---|
| 770,354 | 9/1904 | Corfman | 383/39 |
| 791,598 | 6/1905 | Woodland | 383/22 |
| 962,595 | 6/1910 | Smith | 383/39 |
| 1,684,232 | 9/1928 | Levit | 383/39 |
| 1,845,088 | 2/1932 | Hunerhoff | 190/903 |
| 4,164,968 | 8/1979 | Esposito, Jr. et al. | 383/39 |
| 4,585,127 | 4/1986 | Benedict | 383/39 |

FOREIGN PATENT DOCUMENTS

| | | | |
|---|---|---|---|
| 336215 | 4/1929 | United Kingdom | 383/22 |

*Primary Examiner*—Stephen Marcus
*Assistant Examiner*—Jes F. Pascua

[57] ABSTRACT

The invention relates to a locker bag specifically designed for golfers for storing and organizing the usual golf accessories, valuables and clothing items used by a golfer, male or female. The bag is designed to hang from the inside of the locker door and has a multiplicity of expandable pockets attached to a backing.

17 Claims, 4 Drawing Sheets

HANGABLE COMPARTMENTED BAG

BACKGROUND OF THE INVENTION

1. Field of the Invention

This invention relates primarily but not exclusively to a golfer's needs. More particularly, this invention relates both to the recognition of long-felt needs of a golfer, male or female and to novel conceptual designs for fulfilling those needs. More specifically, the invention relates to fulfilling those needs, the paraphernalia organizational needs of the typical golfer who belongs to a country club or who has a storage locker at such a private club or at a public golf course.

2. Description of the Prior Art

A patent search was carried out directed toward bags or storage devices having a series of pockets with means for closing and open pockets, which are expandable, fastened to a vertical rigid or semi-rigid backing that is equipped with a hanging device, for the storage of personal items.

The following patents were located:

| | | |
|---|---|---|
| Des. | 110,197 - Shapiro | 6/21/38 |
| | 71,598 - Woodland | 6/6/05 |
| | 2,710,638 - Ford | 6/14/55 |
| | 3,139,133 - Spector | 6/30/64 |
| | 4,585,127 - Benedict | 4/29/86 |

The design patent of Shapiro relates to a toilet dressing hanger and is not equipped to handle the locker storage needs of a golfer.

Woodland shows pockets attached to a hanger but the pouch of same is designed to satisfy the needs of rural letter carriers and would not satisfy the hereinafter specified storage requirements of the golf locker bag of the present invention.

The Ford patent discloses a combined utility bag and hanger with attached pockets and pouches. A specific object of the invention is to provide a bag particularly useful for over night and week-end guests in homes and the structure provides pockets for articles usually carried by travelers in order that such articles may not be misplaced and forgotten when the guest leaves. Also, one of the specific purposes of this invention is to have the hanger readily removeable from the bag section to allow for easy laundering of the article. These are not purposes of the golf locker bag of the present invention; nor, on the other hand, would the article of this patent satisfy the storage requirements of the golf locker bag of the present invention.

Spector discloses a portable unit that folds into an easily transportable unit for travel but is unrelated to satisfying the storage requirements of a golfer.

Benedict shows the use of a pocketed device for closet use, wherein the device is supported on a rod that slides into the closet. It also is unrelated to satisfying the storage requirements of a golfer.

OBJECTS OF THE INVENTION

It is an object of the present invention to provide a golfer's locker bag particularly suitable for fulfilling the paraphernalia organizational needs of the typical golfer who belongs to a country club or who has a storage locker at such a private club or at a public golf course.

It is another object of this invention to provide means for fulfilling such needs with highly efficient bag structures for accomplishing same while at the same time employing novel conceptual designs for fulfilling said needs.

It is another object of the present invention to accomplish the foregoing objectives for both male and female golfers.

It is another object of the present invention to provide safeguards against thievery of valuables in certain specifically designed bag embodiments of the present invention.

It is another object of the present invention to accomplish all of the foregoing with bag designs that are attractive and aesthetically pleasing to the eye of the golf locker bag user.

SUMMARY OF THE INVENTION

The invention relates to a locker bag specifically designed for golfers for storing and organizing the usual golf accessories, valuables and clothing items used by a golfer, male or female. The bag is designed to hang from the inside of the locker door and has a multiplicity of expandable pockets attached to a backing. The pockets are arranged in substantially horizontal rows and extend from the backing inwardly into the locker by means of expandable gussets. The pockets are of sufficient number and sufficiently limited in vertical depth that the contents placed in the various pockets of the bag can easily be extracted therefrom, and wherein commingling with undesired objects in any particular pocket is averted.

BRIEF DESCRIPTION OF THE DRAWINGS

A better understanding of the present invention as well as other objects and advantages thereof will become apparent upon consideration of the detailed disclosure thereof, especially when taken with the accompanying drawings, wherein.

DETAILED DESCRIPTION OF THE INVENTION

Figure 1:
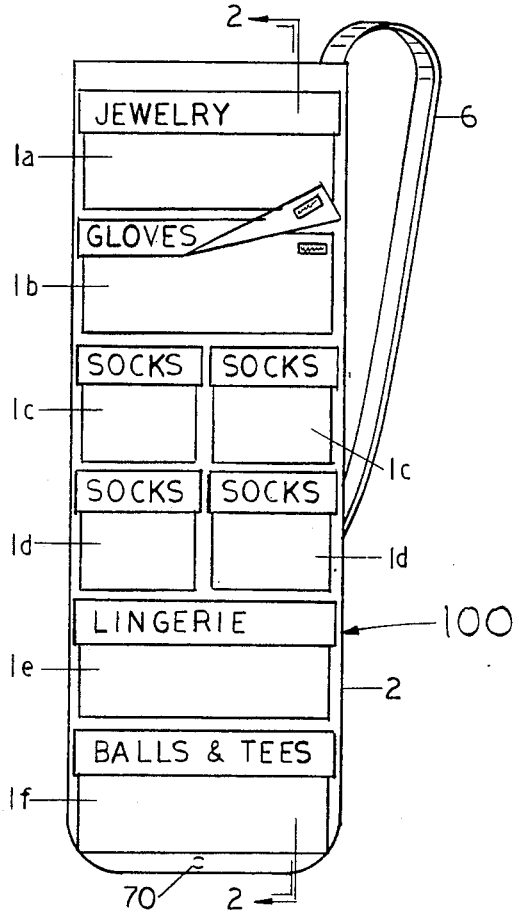
FIG. 1 is a front elevational view of a typical golf locker storage bag of the present invention; the various compartments are labeled and typical dimensions are set forth but it should be understood for this figure and for others illustrated that these are exemplary only and may be varied, depending upon locker size and user performance, etc.
Figure 5:
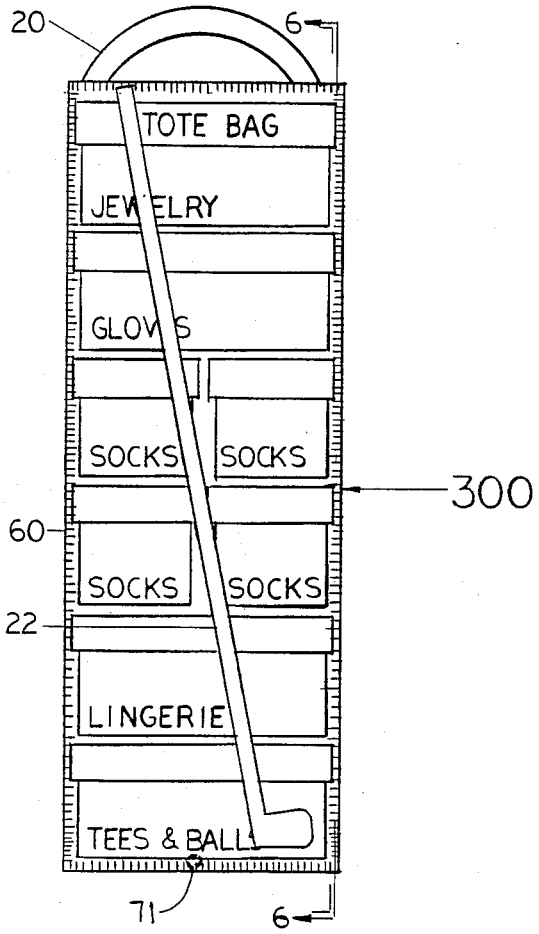
FIG. 5 is a front elevational view of another modified golf locker bag of the present invention wherein the bag may have modifications thereto to make it particularly suitable for portability and/or to hang laundry therefrom, as will be more particularly discussed hereinafter.

Referring now to the foregoing Figures in more detail, the bag 100 illustrated in FIG. 1 is particularly designed for use by a lady golfer. It is multipocketed or has several expandable pockets or compartments, indicated generally by the numeral 1 with a letter following in descending order from top to bottom as 1*a*, 1*b*, 1*c*, 1*d*, 1*e*, and 1*f* as shown. The backing 2 of the bag possesses means 3, such as hooks, near the top thereof to attach to or to hang from the inside of the locker door, such as from the locker vent slits. The hooks extend upwardly and rearwardly from the backing and as seen, for example in FIGS. 1 and 5, are not visible from the side of the backing from which the pockets extend. The backing itself is substantially two-dimensional, said backing being of a width narrower than the width of the locker door and said backing being of a length shorter than the length of the locker door. The pockets or compartments are arranged is substantially horizontal rows and extend from the backing 2 inwardly into the locker by means of expandable gussets 4*a*, 4*b*, 4*c*, 4*d*, 4*e* and 4*f* respectively for the correspondingly lettered pockets 1*a*, 1*b*, etc. The pockets are of sufficient number and sufficiently limited in vertical depth that the contents placed in the various pockets of the bag can easily be extracted therefrom and wherein commingling with undesired objects in any particular pocket is averted. Preferably, all of the pockets of the bag are covered with flaps, correspondingly lettered as flaps 5*a*, 5*b*, 5*c*, 5*d*, 5*e* and 5*f*. In the bag figure illustrated, as well as in other bag designs of the invention, the inner faces of the flaps and/or the outer faces of the gussets are covered by self-adhering fabric Velcro so as to adhere the flaps to the pockets. Also, in this and other bag designs, a slot (not shown) may be provided between the top pocket 1*a* and the backing 2 for the bag, said slot being provided for holding score cards, blank cards or perhaps filled-in cards with scores retained as mementos for proud accomplishments etc.

In the embodiment of FIG. 1, and as is indicated on the drawing, pocket 1*a* is intended for holding jewelry or valuables such as currency or a wallet, etc.; pocket 1*b* is intended to hold golf gloves; pockets 1*c* and 1*d* for holding socks; pocket 1*e* for holding lingerie and pocket 1*f* for holding golf balls and tees and other possible golf accessories such as spare spikes and a spike wrench, etc. The flaps for the pockets may have suitable and attractive labels or insignia or adornments thereon to indicate the contents placed and/or intended to be placed in the various pockets. It is obvious that the arrangement indicated is optional and may be varied depending upon manufacturer and/or designer or user preference.

Also, as illustrated, pockets 1*c* and 1*d* in the third and fourth horizontal row of pockets, are each divided vertically near their mid-points so as to comprise double pockets in each row to accommodate the separate placement therein of differently colored or styled socks, or to separate clean from dirty socks etc. It should be appreciated that certain other modifications of construction may also be made while keeping within the spirit and scope of the invention. For example, pockets 1*c* may be varied in vertical depth to include the depth of pocket 1*d*; or this may be done for example on only one side of the bag etc. Or, the outward shape of the pockets may be changed to appear oval or round instead of square or rectangular.

To accomplish easy extraction of the intended articles from their pockets, and also to avoid co-mixing of separately categorized items to be placed therein, the vertical depth of at least some of the pockets of the locker bag is preferably a maximum no deeper than about 5 inches. The amount of "gusseting" employed for any particular pocket or row of pockets can be varied and/or increased in order to enable the placement therein of the bulkier items and still permit covering and closing the pockets with the hook and loop fabric type fastener secured to the flaps.

The backing 2 for the bag of FIG. 1 is essentially rectangular in shape, but as is apparent from the figures of other bag designs of the present invention, this is also a variable and the backing may be essentially frusto-conical in shape, with the wider dimension being at the top of the bag; or the backing may be tubular or ovoid in shape, etc.

The bag of FIG. 1 is made in the shape of a golf bag, with a vinyl (or other material) strap 6 attached to the top of the bag and to another part of the bag, (e.g. the bottom, or the middle, etc) wherever it's most convenient for manufacturing purposes and/or looks most attractive on said bag.

The illustrated bag of FIG. 1 is substantially 32 inches long and 10 inches wide, but this may obviously be varied depending upon locker size and user preference. The size may also be varied to place adornment at the top of the bag and/or attachments on the bottom, as will become clearer from description of other bag Figures which follow.

The dimensions shown for the pockets of the bag illustrated in FIG. 1 are typical for a locker bag of the size indicated; however, it should be appreciated that golf lockers are made in several sizes of various width and heighths, and bag dimensions and pocket sizes may be altered so as best to accommodate the needs and conveniences of the golfer. In any case, however, the bag will possess pockets in sufficient number and sufficiently limited in vertical depth that the contents placed in the various pockets of the bag can easily be extracted therefrom and wherein commingling with undesired objects in any particular pocket is averted. Typically, also, the bag will possess at least six horizontal rows of pockets in order to accomplish these objectives. As illustrated for the rows for socks, (but not restricted solely to rows for socks), such rows may be divided vertically near their mid-points into two pockets in each row; or, in the case of wider lockers, they may be divided into more than two pockets in each row.

All of the locker bags will be made from materials strong and durable enough to hold the contents of products used by the golfer and to last through reasonable wear and tear conditions. Fabric backed vinyl with stitched and sewn pockets and flaps is a typical material of construction.

The article may also have material put on the back of the backing as a means for attaching one or more handles to enable the golfer to use it as a carrying case for her or his golf needs. A slide fastener such as illustrated at element 60, FIG. 5, may be attached around the perimeter of the bag if it were to be structured for such possible additional use.

A snap 70, as illustrated for example in FIG. 1, or other attaching means may also be placed at the bottom of the locker bags of this invention for removable attachment of a generic laundry bag, to be used or filled if golfer so desires to take laundry home for washing.

Figure 3:
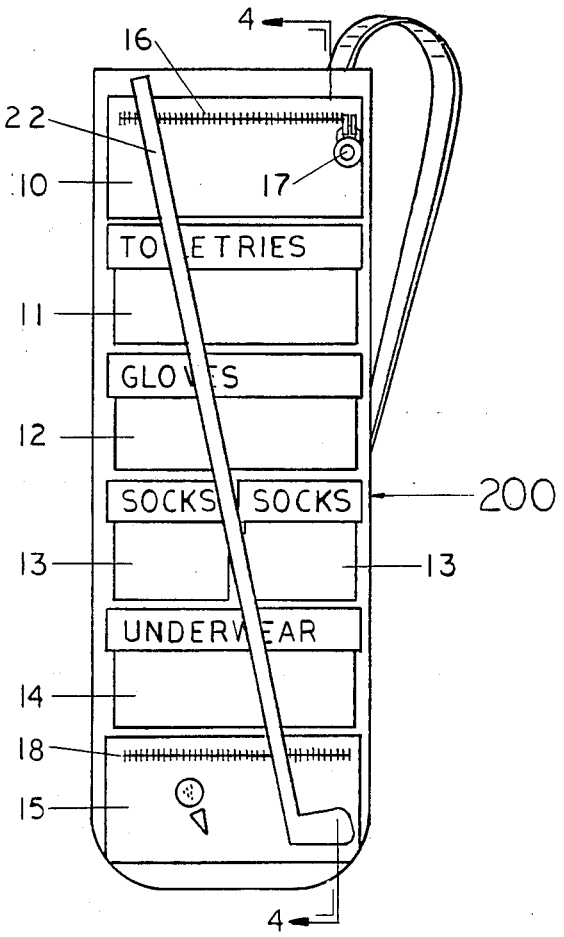
FIG. 3 is a front elevational view of a modified golf locker bag wherein the top pocket or compartment is specially designed for improved protection against thievery and wherein the second pocket from the top is specially designed for holding typical toiletry articles.
Figure 4:
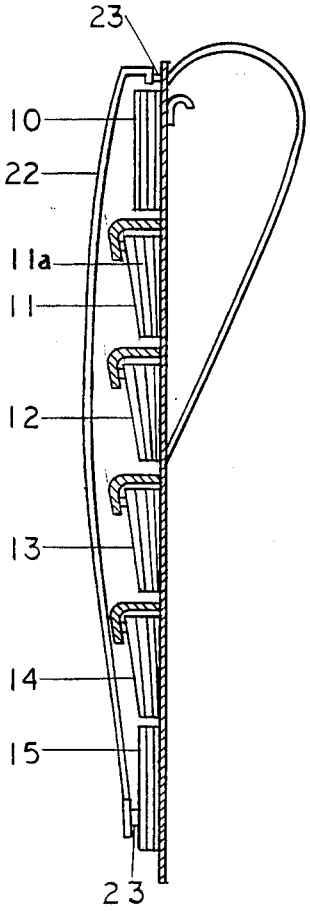
FIG. 4 is a cross-sectional view of the golf locker bag of FIG. 3, taken along the line 4—4 of FIG. 3.

The locker bag 200 illustrated in FIG. 3 and in FIG. 4 has several similarities to the locker bag 100 of FIG. 1 but is for a man's locker bag rather than for a woman's. The top compartment 10 is for the man's valuables, such as for his wallet and watch and other possible jewelry such as tie pins and cuff links, etc. Because of its intended contents, the compartment is provided with a slide fastener 16 which may be secured with a lock 17, preferably a combination lock so as to avoid the need for a separately held or stored key. This safeguard is for security reasons and to require the taking of additional time for pilferage in the case of potential thieves. Although such theft might be unlikely, it does occur, and this safeguard does offer additional deterrence against same, in addition to the lock on the locker door.

Pocket 11 of this bag is designed to hold bulky toiletry articles, such as shampoo, hair brush, comb, razor, tooth paste and tooth brush etc. and is therefore typically provided with more gussets 11*a* for expansion than the rest of the pockets. The balance of the construction of this bag is pocket 12 for golf gloves, pockets 13 for socks, pocket 14 for underwear and pocket 15 for balls and tees etc. Pocket 15 typically and preferably also has a slide fastener, 18.

As with the bag of FIG. 1 and any of the bags of this invention, the pockets of this bag may also have suitable and attractive labels or insignia or adornments thereon to indicate the contents placed and/or intended to be placed in the various pockets.

Figure 2:
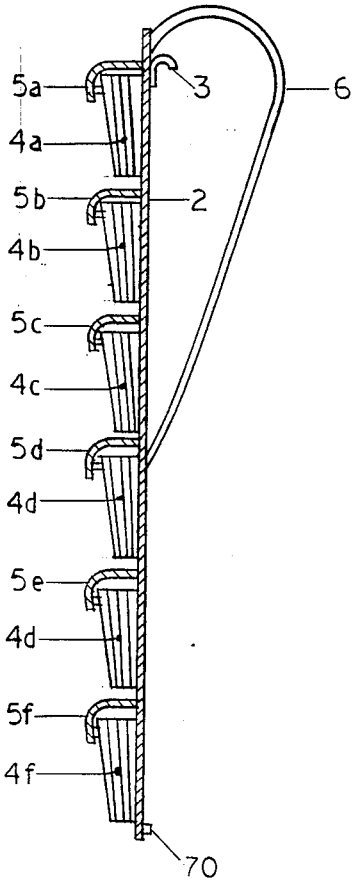
FIG. 2 is a cross-sectional view of the golf locker bag of FIG. 1, taken along the line 2—2 of FIG. 1.
Figure 6:
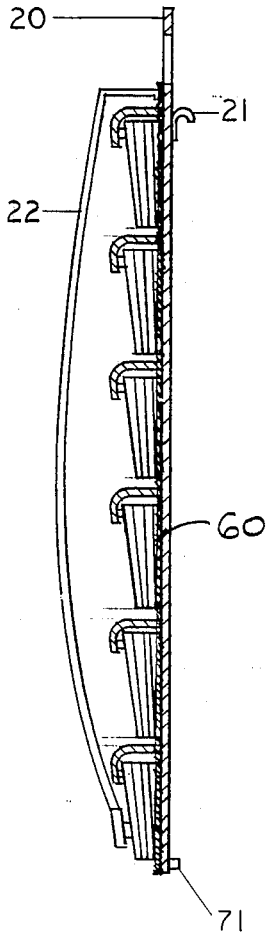
FIG. 6 is a cross-sectional view of the golf locker bag of FIG. 5 taken along the line 6—6 of FIG. 5.

Alternatively, and as illustrated in FIGS. 5 and 6, the bag 300 may be designed as a "TOTE" bag, with a strap 20 attached across its top to enable its user to easily carry it and its contents in a vertical upright position from one location to another, such as from one golf club to another golf club where its owner might wish to use it on occasion. Hooks 21, shown in FIG. 6, enable the bag to be hung at either location. Such a bag will also have the same or very similar pockets and features as described in connection with the bag of FIGS. 1 and 2; and may be designed for use to hold dirty laundry at the bottom thereof in which case it will, for example, have hidden snaps or clips 71, similar to snap 70 on the bottom thereof to hold a laundry bag.

For design and aesthetic purposes, the locker bag of this figure, as well as the locker bags of FIGS. 1 and 3 may have thereon a vinyl strap 22 shaped like a golf club that turns diagnonally or crosswise across the face of the locker bag. It will be flexible and only attached to the rest of the bag near the top and bottom so as not to interfere with any function of the bag or with the opening or closing of any flaps or slide fasteners. Such a strap in the shape of a golf club may also be stitched onto the bag at the very edge of the bag. Such straps for design purposes may also be detachable from the main bag such as by means of snaps 23 or hook and loop fabric type fasteners.

Figure 7:
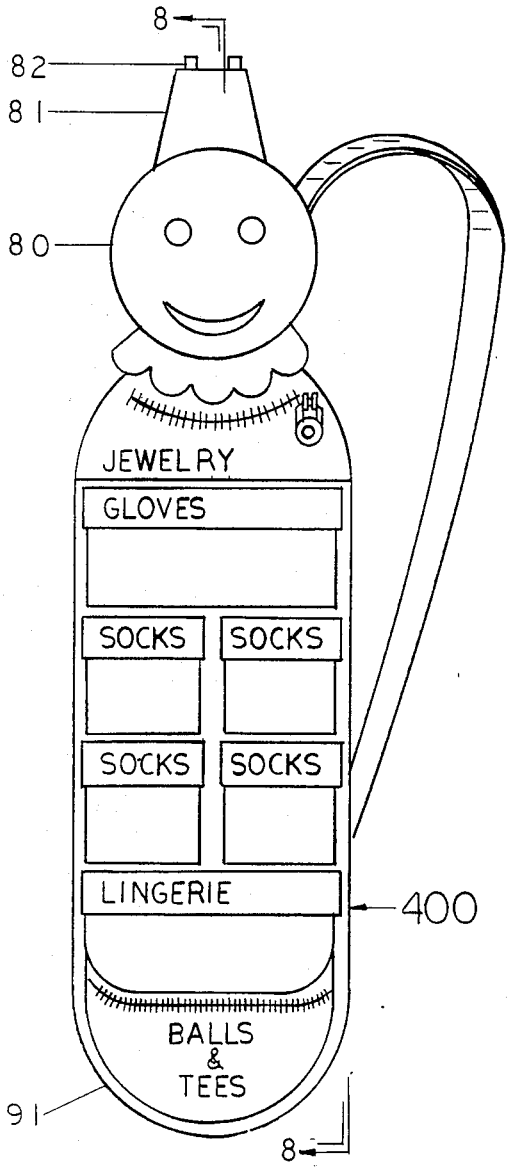
FIG. 7 is a front elevational view of another modified golf locker bag of the present invention wherein the aesthetically pleasing considerations of the locker bag design are given emphasis by the placement of a smiling clown's face at the top of the bag and wherein the general overall shape of the bag is changed from substantially rectangular to substantially ovoid.
Figure 8:
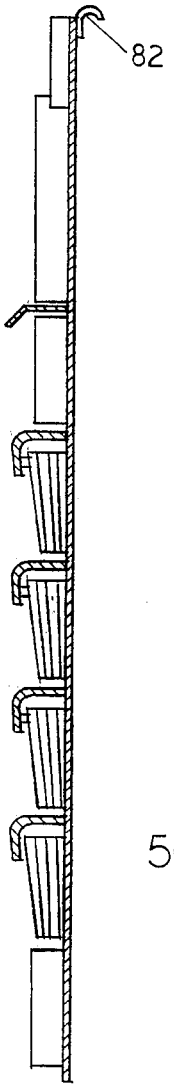
FIG. 8 is a cross-sectional view of the golf locker bag of FIG. 7, taken along the line 8—8 of FIG. 7.
Figure 9:
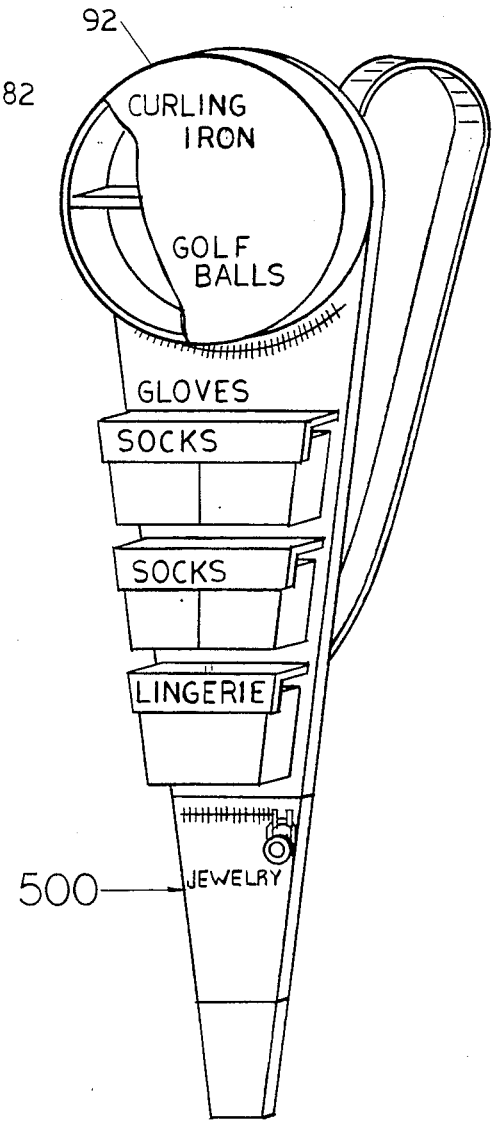
FIG. 9 is another modified golf locker bag of the present invention wherein the bag presents an alternative aesthetically pleasing design as its main distinction over the preceding locker bag configuration, the locker bag of this figure having a conical or frusto-conical shape, with its larger circular cross-section being at the top of the bag.

The bags illustrated in FIGS. 7 and 9 show novel and more aesthetically pleasing designs for a golf locker bag; designs believed more attractive and pleasing particularly to the younger golfing set. The main body of the bag 400 of FIG. 7 is generally ovoid in shape and is topped with a smiling clown's face 80 and the head of the clown is topped with a hat 81. As illustrated in FIGS. 7 and 8, the attaching means 82 which are similar to hooks 3 are, in this embodiment, integrated with the ornamental clown design. The main body of bag 500 of FIG. 9 is conically or frusto-conically shaped like an ice cream cone. Bags 400 and 500 of FIGS. 7 and 9, respectively, also illustrate the formation of arcuate upper and lower edges, 91 and 92 respectively, on backing members 2. The pockets marked for "Jewelry" in each of these figures are provided with snap fasteners and small locks to safeguard against thievery. Obviously the placement of the jewelry pockets in these and other figures may be changed from top to bottom or from bottom to top or to elsewhere. The lock may be either a combination lock or a key lock since women may conveniently wear a small chain key around their neck while either golfing or showering, etc. It should also be appreciated that other aesthetically pleasing designs for golf locker bags are within the spirit and scope of the present invention. For example, the locker bags for ladies may have a doll-like figure (instead of a clown's face) sitting on the golf bag; or two doll-like figures sitting on the golf bag, dressed in golfing attire. Despite their novel design features, the bags illustrated and described for FIGS. 7 and 9 still possess most of the utilitarian aspects or features of the locker bag designs shown in FIGS. 1, 3 and 5.

ADVANTAGES OF THE INVENTION

A golfer's paraphernalia organizational needs are believed unique, particularly because of the variety of items involved and also because of the golfer's activities and the conditions which prevail pertaining to those activities.

Typically a woman or man golfer may arrive at "the club" attired in dress clothes, with a wallet in purse or pocket, and wearing jewelry or a watch, etc., and will then change into her or his golfing clothes. At that point she or he may decide to leave the "valuables" in the golf locker or take such valuables with him or her, thus having to look after or safeguard them during the time he or she is golfing.

After golfing, particularly on hot days, the golfer will typically remove his sport clothes, shower and then change back into the clothes he or she was wearing before getting to the golf club. At this time the safeguarding of valuables is uppermost in the golfer's concern while he or she is showering. Also, toiletry articles are required and/or desired both before and after showering and there is generally also a change, at least of lingerie or underwear and socks, with concomitant need for separating soiled or worn clothing from fresh and/or laundered clothing.

The golfer will typically also have a need for storing spare golf shoes, socks, golf balls and tees etc. and the typical locker will not have means for conveniently and efficiently separating such items from other items typically stored in the locker, such as sport shirts, sweaters, slacks, shirts etc.

The general result is, and informal observations of both men and women's lockers lead to the judgment that the average golf locker is very disorganized, with toiletries mixed in with jewelry and/or wallets, with clean and dirty clothing, with golf balls and tees and score cards strewn every which way. The locker bags of the present invention help avoid such disorganization, help allay concern over jewelry and valuables and the special care that they require, and reduce or eliminate the time involved in shuffling through a lot of disorganized or mixed items such as described.

Numerous modifications and variations of the invention are possible in light of the above teachings and therefore the invention may be practised otherwise than as particularly described.

What is claimed is:

1. A bag for holding a plurality of items and being capable of suspension from the inside of a locker door, said bag comprising a substantially two-dimensional backing having a front face, a rear face, an upper edge and a lower edge; suspension means secured to said rear face adjacent to and spaced below said upper edge; said suspension means extending toward said upper edge and away from said rear face, and being confined within the area of said backing; a plurality of pockets secured to and extending forwardly from said front face; said pockets each including two side walls formed as expandable gussets and a front wall; said pockets being arranged in horizontal rows.

2. A bag as recited in claim 1 and further comprising means affixed to said bag adjacent said lower edge for attaching a diverse bag to said bag.

3. A bag as recited in claim 2 wherein said means for attaching is concealed.

4. A bag as recited in claim 1 and further comprising a strap element affixed to said bag, said strap element being secured to said front face and extending over the front walls of at least some of said pockets but being spaced from said pockets in a direction away from said front face to preclude interference with access to said pockets.

5. A bag as recited in claim 4 wherein at least one end of said strap element is detachable from said bag.

6. A bag as recited in claim 1 and further comprising a strap member secured to said rear face at spaced locations of said rear face.

7. A bag according to claim 6 wherein the bag also possesses a slide fastener around its perimeter so that its contents may be enclosed.

8. A bag as recited in claim 6 wherein one of said spaced locations is adjacent a point intermediate said upper edge and said lower edge.

9. A bag as recited in claim 1 and further comprising an individual cover element for each of said pockets.

10. A bag as recited in claim 9 wherein at least one of said cover elements is releasably closeable by means of a slide fastener.

11. A bag as recited in claim 10 and further comprising a lock associated with said slide fastener.

12. A bag as recited in claim 9 wherein at least one of said cover elements is releasably closeable by means of a hook and loop fabric type closure element.

13. A bag as recited in claim 1 wherein said pockets are individually dimensioned to receive various golf accessories and golfer's paraphernalia whereby said bag is adapted for use as a golf locker bag.

14. A bag as recited in claim 13 wherein said pockets have indicia descriptive of said various accessories and paraphernalia associated therewith.

15. A bag as recited in claim 1 wherein said backing is formed in a tapered shaped.

16. A bag as recited in claim 1 wherein one of said upper and lower edges is arcuate.

17. A bag for holding a plurality of items and being capable of suspension from the inside of a locker door, said by comprising:

a substantially two-dimensional backing having a front face, a rear face, an upper edge and a lower edge; an ornamental figure adjacent said upper edge; suspension means extending upwardly away from said upper edge and rearwardly away from said rear face, and being integrated with said ornamental figure; a plurality of pockets seamed to and extending forwardly from said front face; said pockets each including two side walls formed as expandable gussets and a front wall; said pockets being arranged in horizontal rows.

* * * * *